US010658134B2

(12) United States Patent
Lin

(10) Patent No.: US 10,658,134 B2
(45) Date of Patent: May 19, 2020

(54) KEYBOARD

(71) Applicant: Chicony Electronics Co., Ltd., New Taipei (TW)

(72) Inventor: Dian-Yu Lin, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/228,706

(22) Filed: Dec. 20, 2018

(65) Prior Publication Data

US 2020/0051760 A1 Feb. 13, 2020

(30) Foreign Application Priority Data

Aug. 7, 2018 (TW) ..... 107127484 A

(51) Int. Cl.
*H01H 13/70* (2006.01)
*H01H 13/7065* (2006.01)

(52) U.S. Cl.
CPC ..... *H01H 13/7065* (2013.01); *H01H 2221/04* (2013.01); *H01H 2221/058* (2013.01)

(58) Field of Classification Search
CPC ..... H01H 2221/04; H01H 13/7065; H01H 2221/058; H01H 13/52; H01H 13/70; H01H 13/84; H01H 13/83
USPC ..... 200/5 A, 245, 344, 337; 335/205–207
See application file for complete search history.

(56) References Cited

U.S. PATENT DOCUMENTS

2014/0014486 A1* 1/2014 Knighton ..... H01H 13/52 200/5 A
2014/0118264 A1* 5/2014 Leong ..... G06F 3/0202 345/168
2015/0047959 A1* 2/2015 Wu ..... H01H 3/125 200/344

* cited by examiner

*Primary Examiner* — Edwin A. Leon
*Assistant Examiner* — Iman Malakooti
(74) *Attorney, Agent, or Firm* — CKC & Partners Co., LLC

(57) ABSTRACT

A keyboard includes a bottom plate and keyswitch devices. Each keyswitch device includes a keycap, a first supporting member, and a second supporting member. The keycap is over the bottom plate. The first and second supporting members are connected between the bottom plate and the keycap and respectively include first and second magnetic attraction portions. The second magnetic attraction portion is configured to attract the first magnetic attraction portion. The first and second magnetic attraction portions respectively have first and second abutting surfaces. When the first abutting surface abuts against the second abutting surface, the keycap is at a highest position relative to the bottom plate. When the keycap moves toward the bottom plate from the highest position, the first abutting surface is at least partially separated from the second abutting surface.

18 Claims, 8 Drawing Sheets

KEYBOARD

CROSS-REFERENCE TO RELATED APPLICATION

This application claims priority to Taiwan Application Serial Number 107127484, filed Aug. 7, 2018, which is herein incorporated by reference.

BACKGROUND

Technical Field

The present disclosure relates to a keyboard, and more particularly, to a keyboard that is in favor of reducing the thickness.

Description of Related Art

Currently, the keyswitch device is one of the indispensable input devices to enter text or numbers while using a personal computer (PC). Moreover, consumer electronic products used in daily life or large-scale processing equipment used in the industrial sector require key structure units as input devices to be operated.

For a keyswitch of the keyswitch device, in order to guide the keycap to vertically move, a supporting structure is generally disposed under the keycap of the keyswitch. For example, a conventional scissors-like supporting structure is constituted of two supporting members pivotally connected to each other. In addition, in order to balance the force applied onto the keyswitch by a user, a balance bar is also generally disposed under the keycap of the keyswitch. As such, no matter being applied at an edge or a corner of the keycap, the force can be spread evenly across the entire surface of the keycap.

For a current notebook computer, its development direction is aiming to lightness and thinness, therefore the keyboard structure thereof must be improved to meet the above requirements and also has to reduce the overall vertical height of the keyswitches and simplify the mechanism, so as to better meet the current modification direction and market demand of electronic devices. However, the conventional scissors-like supporting structure occupies a certain vertical height. As a result, a certain height space of the notebook computer must be reserved for the keyboard for installation, which makes the overall thickness of the notebook computer unable to be reduced.

Accordingly, how to provide a keyboard to solve the aforementioned problems becomes an important issue to be solved by those in the industry.

SUMMARY

An aspect of the disclosure is to provide a keyboard that can efficiently solve the aforementioned problems.

According to an embodiment of the disclosure, a keyboard includes a bottom plate and a plurality of keyswitch devices. Each of the keyswitch devices includes a keycap, a first supporting member, and a second supporting member. The keycap is over the bottom plate. The first supporting member is connected between the bottom plate and the keycap and includes a first magnetic attraction portion. The first magnetic attraction portion has a first abutting surface. The second supporting member is connected between the bottom plate and the keycap and includes a second magnetic attraction portion configured to attract the first magnetic attraction portion. The second magnetic attraction portion has a second abutting surface. When the first abutting surface abuts against the second abutting surface, the keycap is at a highest position relative to the bottom plate. When the keycap moves toward the bottom plate from the highest position, the first abutting surface is at least partially separated from the second abutting surface.

In an embodiment of the disclosure, each of the first supporting member and the second supporting member has a lower engaging shaft and an upper engaging shaft respectively engaged with the bottom plate and the keycap.

In an embodiment of the disclosure, the first supporting member and the second supporting member are arranged in a horizontally symmetrical manner. A distance between the lower engaging shafts is smaller than a distance between the upper engaging shafts.

In an embodiment of the disclosure, the first magnetic attraction portion is proximal to the lower engaging shaft of the first supporting member. The second supporting member is proximal to the lower engaging shaft of the second supporting member.

In an embodiment of the disclosure, an attraction interface between the first magnetic attraction portion and the second magnetic attraction portion is between the lower engaging shafts.

In an embodiment of the disclosure, the keycap has an engaging structure having an engaging hole. One of the upper engaging shafts is rotatably engaged with the engaging hole.

In an embodiment of the disclosure, the upper engaging shaft that is engaged with the engaging hole is further slidably engaged with the engaging hole.

In an embodiment of the disclosure, the engaging hole is in the shape of an elongated slot and extends substantially parallel to the bottom plate.

In an embodiment of the disclosure, the bottom plate has a hook, and one of the lower engaging shafts is slidably engaged with the hook.

In an embodiment of the disclosure, one of the first supporting member and the second supporting member further has a triggering portion. The triggering portion faces toward the bottom plate and faces away from the keycap.

In an embodiment of the disclosure, the triggering portion is proximal to one of the lower engaging shafts.

In an embodiment of the disclosure, the first magnetic attraction portion further has a third abutting surface connected to the first abutting surface. When the keycap moves to a lowest position relative to the bottom plate, the third abutting surface abuts against the second abutting surface.

In an embodiment of the disclosure, the first magnetic attraction portion further has a third abutting surface connected to the first abutting surface. The second magnetic attraction portion further has a fourth abutting surface connected to the second abutting surface. When the keycap moves to a lowest position relative to the bottom plate, the third abutting surface abuts against the fourth abutting surface.

In an embodiment of the disclosure, the first supporting member further includes a main body portion. One end of the main body portion is connected to the first magnetic attraction portion. The main body portion includes a metal material.

In an embodiment of the disclosure, the first supporting member is ring-shaped.

In an embodiment of the disclosure, the main body portion and the first magnetic attraction portion are connected through a cold solder.

In an embodiment of the disclosure, the keyboard further includes a circuit board disposed on the bottom plate.

In an embodiment of the disclosure, the first supporting member and the second supporting member respectively have a first opening portion and a second opening portion.

In an embodiment of the disclosure, the keyswitch devices each further includes a third supporting member and a fourth supporting member. The third supporting member is connected between the bottom plate and the keycap and pivotally connected to an inner edge of the first opening portion. The fourth supporting member is connected between the bottom plate and the keycap and pivotally connected to an inner edge of the second opening portion.

Accordingly, in the keyboard of the present disclosure, the two supporting members guide the keycap to move toward and away from the bottom plate, and the two magnetic attraction portions that are respectively disposed on the supporting members and attract each other cause the keycap to return to its original position when the keycap is not pressed. The magnetic attraction portions can replace conventional rubber domes, so as to effectively reduce the stroke of the keycap and thus help to thin the keyboard. Furthermore, the first supporting member and the second supporting member are arranged in the horizontally symmetrical manner and each at least partially includes a metal material, so the keyboard adopting the first supporting member and the second supporting member still has enough structural strength even a conventional balance bar is not installed therein.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
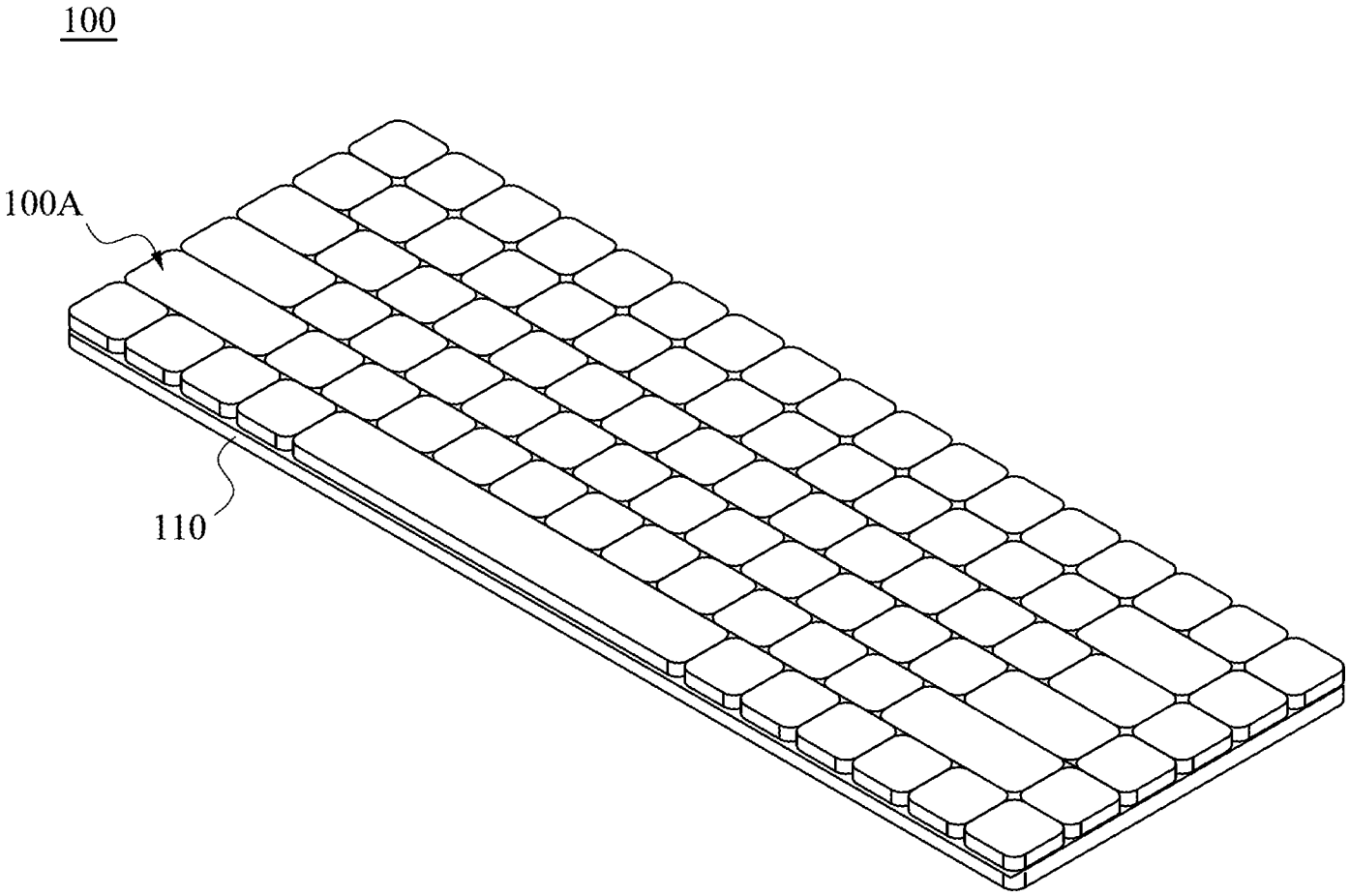
FIG. 1A is a perspective view of a keyboard according to some embodiments of the disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Figure 1B:
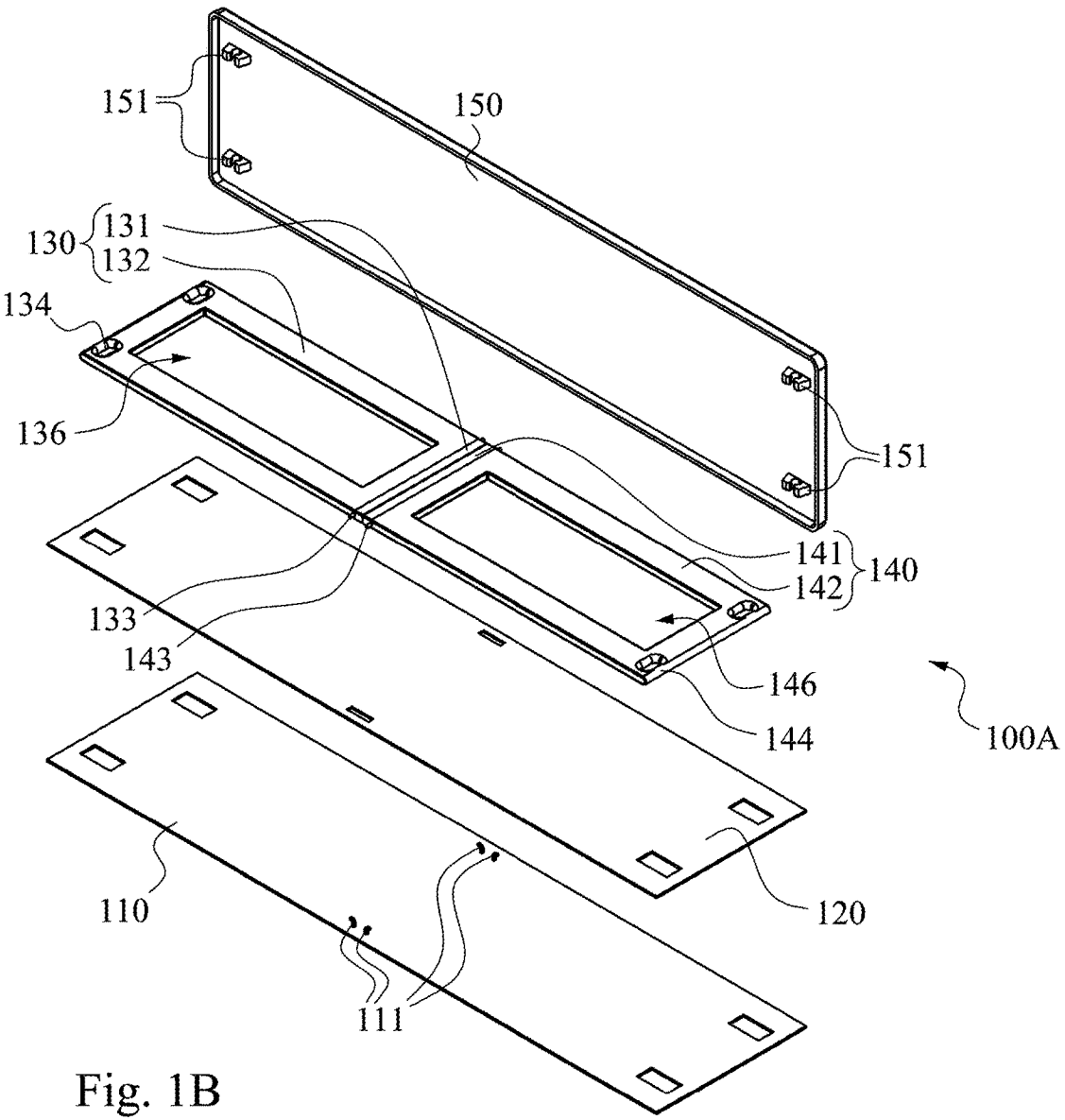
FIG. 1B is an exploded view of a keyswitch device, a part of a bottom plate, and a part of a circuit board of the keyboard shown in FIG. 1A.

Reference is made to FIGS. 1A and 1B. FIG. 1A is a perspective view of a keyboard 100 according to some embodiments of the disclosure. FIG. 1B is an exploded view of a keyswitch device 100A, a part of a bottom plate 110, and a part of a circuit board 120 of the keyboard 100 shown in FIG. 1A. As shown in FIGS. 1A and 1B, the keyboard 100 of the disclosure can be an external keyboard (e.g., a keyboard with a PS/2 interface or a keyboard with a USB interface) used in a desktop computer, or can be a part of a computer system having an input device (e.g., a touch pad on a notebook computer) that is in the form of a keyswitch, but the disclosure is not limited in this regard. That is, concepts of the keyboard 100 of the disclosure can be used in any electronic product that performs input function by pressing. In the present embodiment, the keyboard 100 includes the bottom plate 110, the circuit board 120, and a plurality of keyswitch devices 100A. Structures and functions of components included in the keyboard 100 and connection and operation relationships among these components are described in detail below.

Figure 2A:
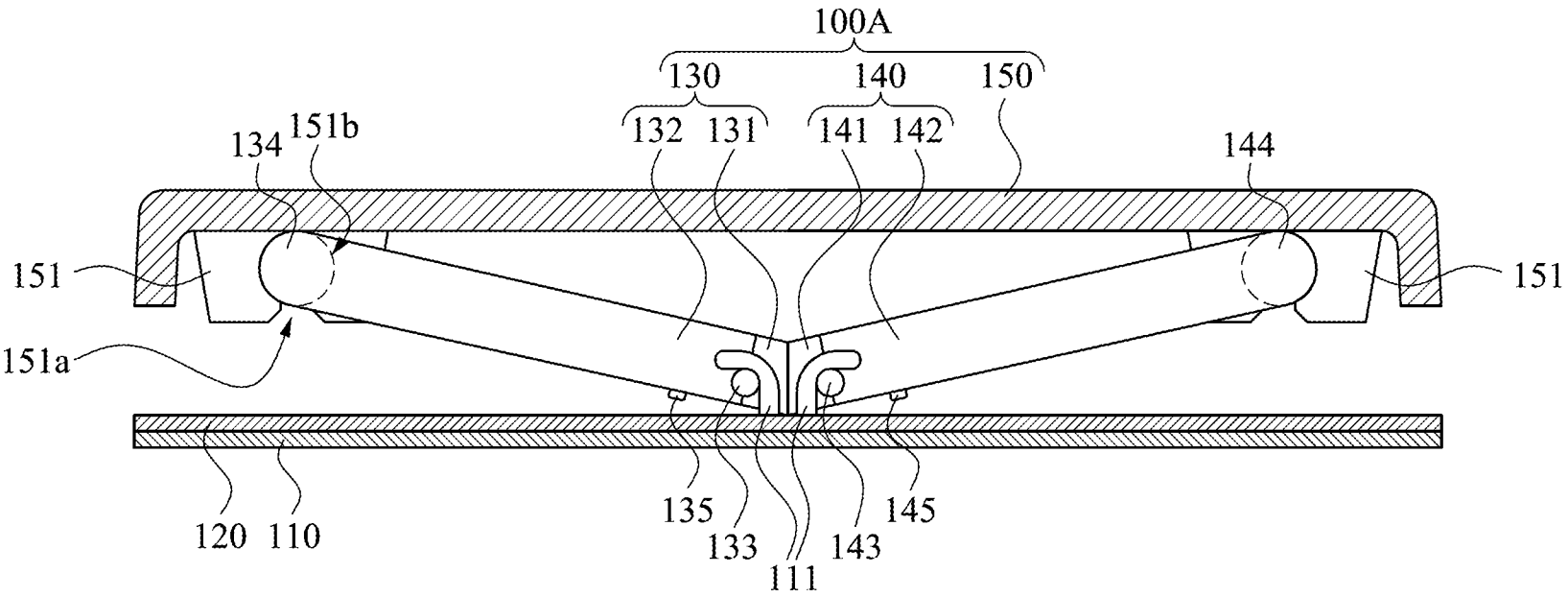
FIG. 2A is a cross-sectional view of the keyswitch device of the keyboard shown in FIG. 1A, in which a keycap is at a highest position relative to the bottom plate.
Figure 2B:
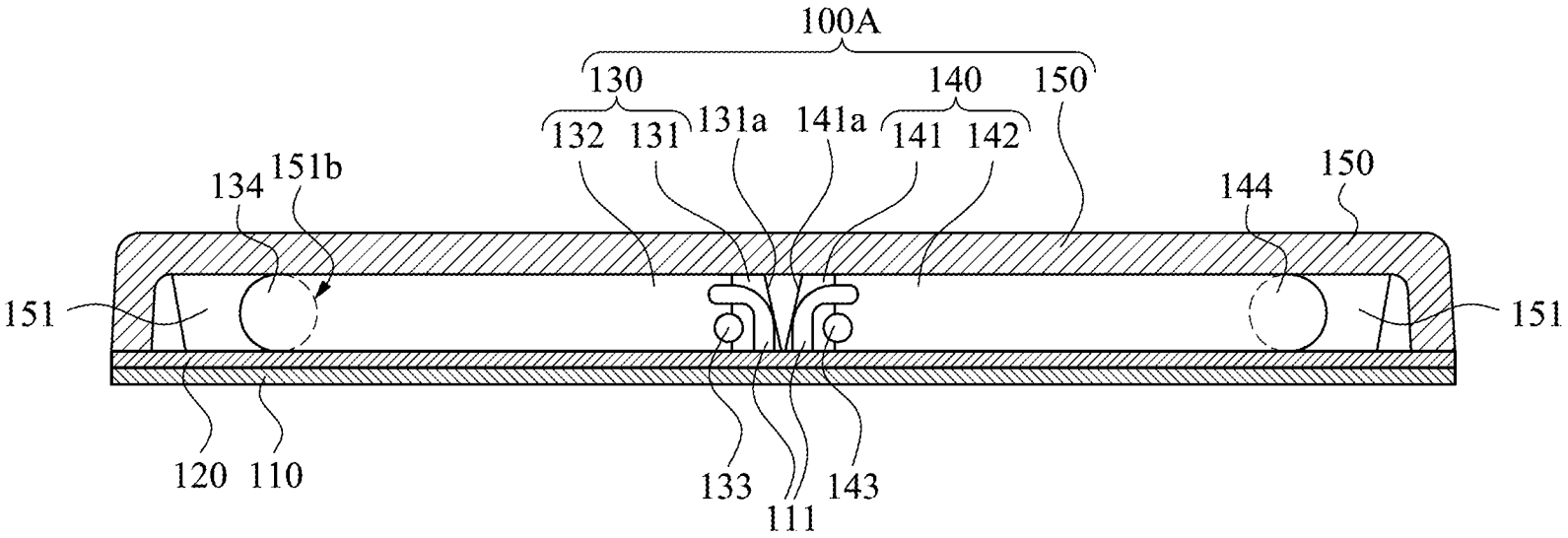
FIG. 2B is another cross-sectional view of the keyswitch device of the keyboard shown in FIG. 1A, in which the keycap is at a lowest position relative to the bottom plate.

Reference is also made to FIGS. 2A and 2B. FIG. 2A is a cross-sectional view of the keyswitch device 100A of the keyboard 100 shown in FIG. 1A. FIG. 2B is another cross-sectional view of the keyswitch device 100A of the keyboard 100 shown in FIG. 1A.

In the present embodiment, each of the keyswitch devices 100A includes a first supporting member 130, a second supporting member 140, and a keycap 150. As shown in FIG. 2A, the keycap 150 is at a highest position relative to the bottom plate 110. As shown in FIG. 2B, the keycap 150 is at a lowest position relative to the bottom plate 110. The keycap 150 is over the bottom plate 110. The circuit board 120 is disposed on the bottom plate 110 and between the bottom plate 110 and the keycap 150. The first supporting member 130 and the second supporting member 140 are connected between the bottom plate 110 and the keycap 150 and configured to guide the keycap 150 to move toward and away from the bottom plate 110. The first supporting member 130 includes a first magnetic attraction portion 131. The second supporting member 140 includes a second magnetic attraction portion 141. The second magnetic attraction portion 141 is configured to attract the first magnetic attraction portion 131. As shown in FIG. 2B, the first magnetic attraction portion 131 has a first abutting surface 131*a*, and the second magnetic attraction 141 has a second abutting surface 141*a*. When the first abutting surface 131*a* abuts against the second abutting surface 141*a* (referring to FIG. 2A), the keycap 150 is at the highest position relative to the bottom plate 110. When the keycap 150 moves toward the bottom plate 110 from the highest position (referring to FIG. 2B), the first abutting surface 131*a* is at least partially separated from the second abutting surface 141*a*. For example, the first abutting surface 131*a* and the second abutting surface 141*a* only abut against each other at lower edges thereof as shown in FIG. 2B.

Under the foregoing structural configurations of the keyswitch device 100A of the present embodiment, the first magnetic attraction portion 131 and the second magnetic attraction portion 141 that are respectively disposed on the first supporting member 130 and the second supporting member 140 and attract each other can achieve the purpose of returning the keycap 150 to the highest position when the keycap 150 is not pressed. Therefore, the first magnetic attraction portion 131 and the second magnetic attraction portion 141 can replace conventional rubber domes, so as to effectively reduce the stroke of the keycap 150 and thus help to thin the keyswitch device 100A and the keyboard 100.

As shown in FIGS. 2A and 2B, the first abutting surface 131*a* and the second abutting surface 141*a* are both flat surfaces, so as to position the keycap 150 at the highest position relative to the bottom plate 110 when the first abutting surface 131*a* and the second abutting surface 141*a* abut against each other, but the disclosure is not limited in this regard. In practical applications, the purpose of positioning the keycap 150 at the highest position can also be achieved as the first abutting surface 131*a* and the second abutting surface 141*a* have complementary shapes.

As shown in FIG. 1B, the first supporting member 130 has a lower engaging shaft 133 and an upper engaging shaft 134, and the second supporting member 140 has a lower engaging shaft 143 and an upper engaging shaft 144. The lower engaging shafts 133, 143 are engaged with the bottom plate 110. The upper engaging shafts 134, 144 are engaged with the keycap 150. As shown in FIG. 2A, the first supporting member 130 and the second supporting member 140 are arranged in a horizontally symmetrical manner. That is, in a direction substantially perpendicular to the moving path of the keycap 150 relative to the bottom plate 110, the first supporting member 130 and the second supporting member 140 are symmetrically arranged. Furthermore, the first supporting member 130 further includes a main body portion 132. The main body portion 132 is connected to the first magnetic attraction portion 131. The second supporting member 140 further includes a main body portion 142. The main body portion 142 is connected to the second magnetic attraction portion 141. The main body portions 132, 142 include a metal material. With the structural configurations, the keyswitch device 100A adopting the first supporting member 130 and the second supporting member 140 still has enough structural strength even a conventional balance bar is not installed, and function failure caused by wobbling of the keycap 150 when the corners of the keycap 150 are pressed can be effectively avoided.

In the present embodiment, a distance between the lower engaging shafts 133, 143 is smaller than a distance between the upper engaging shafts 134, 144. In addition, the first magnetic attraction portion 131 is proximal to the lower engaging shaft 133 and distal to the upper engaging shaft 134, and the second supporting member 140 is proximal to the lower engaging shaft 143 and distal to the upper engaging shaft 144. Hence, the first supporting member 130 and the second supporting member 140 form a V shape as shown in FIG. 2A, and the attraction interface between the first magnetic attraction portion 131 and the second magnetic attraction portion 141 is between the lower engaging shafts 133, 143. Specifically, an end of the main body portion 132 is connected to the first magnetic attraction portion 131, and another end of the main body portion 132 is connected to the upper engaging shaft 134; and an end of the main body portion 142 is connected to the second magnetic attraction portion 141, and another end of the main body portion 142 is connected to the upper engaging shaft 144.

However, the disclosure is not limited in this regard. In some other embodiments, the first supporting member 130 and the second supporting member 140 can alternatively form an inverted V shape. That is, the distance between the upper engaging shafts 134, 144 is smaller than the distance between the lower engaging shafts 133, 143. The first magnetic attraction portion 131 is proximal to the upper engaging shaft 134 and distal to the lower engaging shaft 133, and the second supporting member 140 is proximal to the upper engaging shaft 144 and distal to the lower engaging shaft 143. Hence, the attraction interface between the first magnetic attraction portion 131 and the second magnetic attraction portion 141 is between the upper engaging shafts 134, 144. Specifically, an end of the main body portion 132 is connected to the first magnetic attraction portion 131, and another end of the main body portion 132 is connected to the lower engaging shaft 133; and an end of the main body portion 142 is connected to the second magnetic attraction portion 141, and another end of the main body portion 142 is connected to the lower engaging shaft 143.

In some embodiments, the first magnetic attraction portion 131 is a magnet, and the second magnetic attraction portion 141 includes a ferromagnetic material, so as to achieve the purpose of attracting each other.

In some embodiments, the first magnetic attraction portion 131 and the main body portion 132 of the first supporting member 130 are connected through a cold solder, but the disclosure is not limited in this regard.

In some embodiments, the second magnetic attraction portion 141 and the main body portion 142 of the second supporting member 140 include the same material. In some embodiments, the second supporting member 140 is a single piece that is integrally formed.

As shown in FIG. 2A, the keycap 150 has engaging structures 151 (only one of which is representatively labelled in FIG. 2A). The engaging structures 151 each have an engaging hole 151*b* (indicated by a dotted line). The upper engaging shafts 134, 144 of the first supporting member 130 and the second supporting member 140 are rotatably engaged with the engaging holes 151*b* respectively. The bottom surfaces of the engaging structures 151 have entrances 151*a* in communication with the engaging holes 151*b* respectively, and the entrances 151*a* inwardly shrink relative to the engaging holes 151*b*, so that a combination of one of the entrances 151*a* and a corresponding one of the engaging holes 151*b* is also known as a drop hole. While assembling, a user can press the upper engaging shafts 134, 144 to pass through the entrances 151*a* (by deformation of the engaging structures 151) respectively, so as to make the upper engaging shafts 134, 144 be rotatably engaged with the engaging holes 151*b*.

As shown in FIG. 2A, the bottom plate 110 has hooks 111 (only one of which is representatively labelled in FIG. 2A). The hooks 111 pass through the circuit board 120 such that the lower engaging shafts 133, 143 are slidably engaged with the hooks 111 respectively.

However, the disclosure is not limited in this regard. In some other embodiments, the engaging way between the keycap 150 and the upper engaging shafts 134, 144 can be replaced with the engaging way between the bottom plate 110 and the lower engaging shafts 133, 143. That is, the upper engaging shafts 134, 144 are slidably engaged with the keycap 150, and the lower engaging shafts 133, 143 are rotatably engaged with the bottom plate 110 correspondingly.

In addition, as shown in FIG. 2A, the first supporting member 130 and the second supporting member 140 further has triggering portions 135, 145 respectively. The triggering portions 135, 145 face toward the bottom plate 110 and face away from the keycap 150. As such, when the keycap 150 is pressed and located at the lowest position relative to the bottom plate 110 as shown in FIG. 2B, the triggering portions 135, 145 can contact the circuit board 120 and conduct the switching circuits thereon, so that the keyswitch device 100A can achieve the purpose of outputting electrical signals.

Furthermore, in the embodiment, the triggering portion 135 is proximal to lower engaging shaft 133 and distal to the upper engaging shaft 134, and the triggering portion 145 is proximal to lower engaging shaft 143 and distal to the upper engaging shaft 144. Under the structural configurations, because the triggering portions 135, 145 can be near to the circuit board 120 when the keycap 150 is at the highest position relative to the bottom plate 110 (as shown in FIG. 2A), the triggering portions 135, 145 can trigger the switching circuits on the circuit board 120 more easily.

In practical applications, the keyswitch device 100A can only has the triggering portion 135 disposed on the first supporting member 130 or only has the triggering portion 145 disposed on the second supporting member 140.

As shown in FIG. 1B, in the present embodiment, the first supporting member 130 and the second supporting member 140 respectively have a first opening portion 136 and a second opening portion 146. As a specific example, both of the first opening portion 136 and the second opening portion 146 are enclosed, so the first supporting member 130 and the second supporting member 140 are ring-shaped. With the structural configurations, the first supporting member 130 and the second supporting member 140 of the present embodiment not only can provide sufficient structural strength, but also reduce the cost of materials.

Figure 3B:
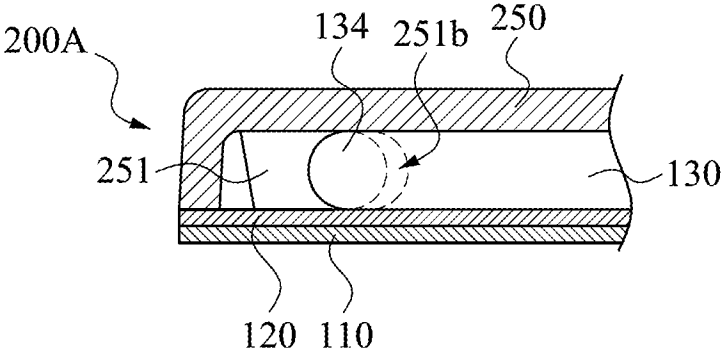
FIG. 3B is another partial cross-sectional view of the keyswitch device shown in FIG. 3A, in which the keycap is at the lowest position relative to the bottom plate.
Figure 3A:
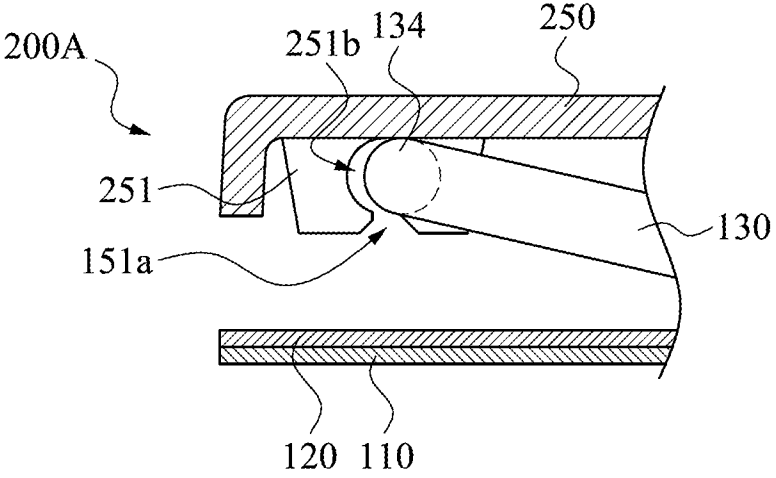
FIG. 3A is a partial cross-sectional view of a keyswitch device of the keyboard according to some embodiments of the disclosure, in which a keycap is at the highest position relative to the bottom plate.

Reference is made to FIGS. 3A and 3B. FIG. 3A is a partial cross-sectional view of a keyswitch device 200A of the keyboard 100 according to some embodiments of the disclosure, in which a keycap 250 is at the highest position relative to the bottom plate 110. FIG. 3B is another partial cross-sectional view of the keyswitch device 200A shown in FIG. 3A, in which the keycap 250 is at the lowest position relative to the bottom plate 110. Compared with the embodiment shown in FIG. 2A, the keyswitch device 200A of the present embodiment mainly modifies the engaging structure 251 of the keycap 250, and the first supporting member 130 and the second supporting member 140 (not shown and can be referred to FIG. 2A) included in the keyswitch device 200A can be referred to the above related descriptions and would not repeated here for simplicity. Specifically, in the present embodiment, the engaging hole 251*b* is in the shape of an elongated slot and extends substantially parallel to the bottom plate 110. The upper engaging shaft 134 that is engaged with the engaging hole 251*b* is further slidably engaged with the engaging hole 251*b*. That is, the upper engaging shaft 134 is slidably and rotatably engaged with the engaging hole 251*b*.

Under the foregoing structural configurations, the upper engaging shaft 134 can slide to an end of the engaging hole 251*b* when the keycap 250 is at the lowest position relative to the bottom plate 110 (referring to FIG. 3B). Hence, in a direction substantially parallel to the bottom plate 110, the engaging hole 251*b* in the shape of the elongated slot can provide a moving space for the first supporting member 130. Under the foregoing structural configurations, the lower edges of the first abutting surface 131*a* and the second abutting surface 141*a* can avoid wear and tear due to excessive pushing when the keycap 250 is at the lowest position relative to the bottom plate 110.

In some embodiments, the upper engaging shaft 144 of the second supporting member 140 can also be engaged with another engaging hole 251*b*, so as to be slidably and rotatably engaged with said another engaging hole 251*b*.

Figure 4B:
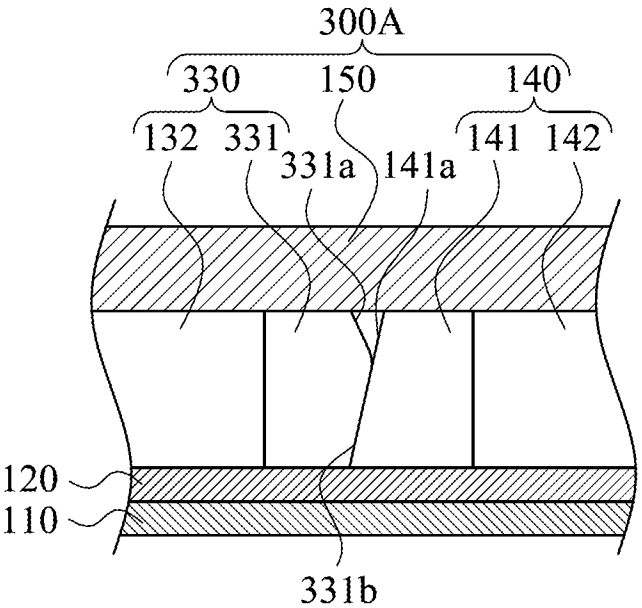
FIG. 4B is another partial cross-sectional view of the keyswitch device shown in FIG. 4A, in which the keycap is at the lowest position relative to the bottom plate.
Figure 4A:
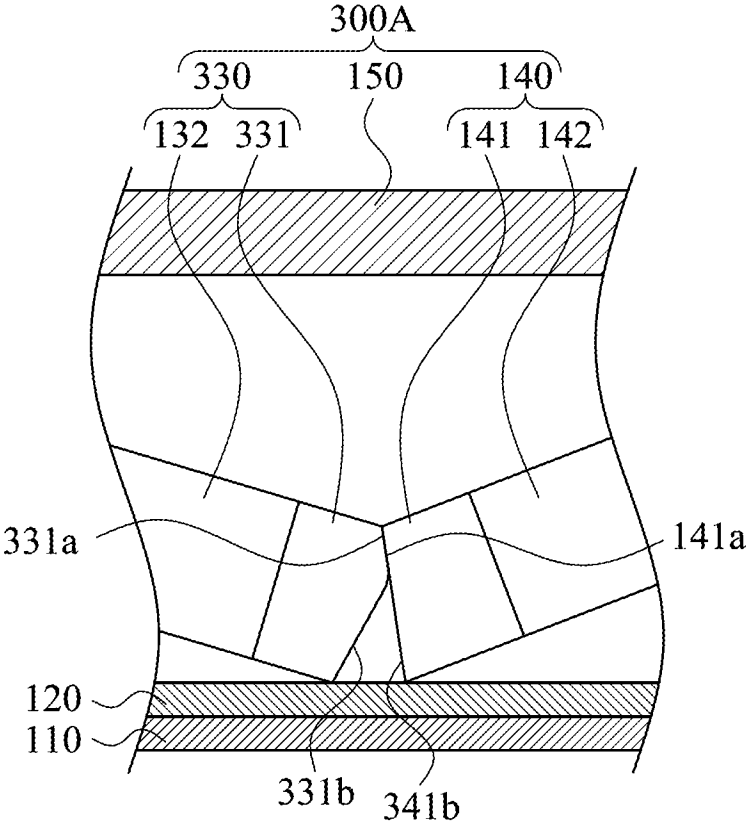
FIG. 4A is a partial cross-sectional view of a keyswitch device of the keyboard according to some embodiments of the disclosure, in which the keycap is at the highest position relative to the bottom plate.

Reference is made to FIGS. 4A and 4B. FIG. 4A is a partial cross-sectional view of a keyswitch device 300A of the keyboard 100 according to some embodiments of the disclosure, in which the keycap 150 is at the highest position relative to the bottom plate 110. FIG. 4B is another partial cross-sectional view of the keyswitch device 300A shown in FIG. 4A, in which the keycap 150 is at the lowest position relative to the bottom plate 110. Compared with the embodiment shown in FIG. 2A, the keyswitch device 300A of the present embodiment mainly modifies the first magnetic attraction portion 331 of the first supporting member 330, and the second supporting member 140 and the keycap 150 included in the keyswitch device 300A can be referred to the above related descriptions and would not repeated here for simplicity. Specifically, in the present embodiment, the first magnetic attraction portion 331 further has a third abutting surface 331*b* in addition to the first abutting surface 331*a*. The third abutting surface 331*b* is connected to the first abutting surface 331*a*. When the keycap 150 is at the highest position relative to the bottom plate 110, the first abutting surface 331*a* abuts against the second abutting surface 141*a*, and the third abutting surface 331*b* is inclined away from the second abutting surface 141*a* at the same time. When the keycap 150 moves to the lowest position relative to the bottom plate 110, the third abutting surface 331*b* abuts against the second abutting surface 141*a*, and the first abutting surface 331*a* is separated from the second abutting surface 141*a*. That is, the first magnetic attraction portion 331 and the second magnetic attraction portion 141 respectively disposed on the first supporting member 330 and the second supporting member 140 attract each other, and the first abutting surface 331*a* abuts against the second abutting surface 141*a*, so as to achieve the purpose of returning the keycap 150 to the highest position when the keycap 150 is not pressed. When the first abutting surface 331*a* abuts against the second abutting surface 141*a* (referring to FIG. 4A), the keycap 150 is at the highest position relative to the bottom plate 110. When the keycap 150 moves toward the bottom plate 110 from the highest position (referring to FIG. 4B), the first abutting surface 331*a* is separated from the second abutting surface 141*a*, and the third abutting surface 331*b* abuts against the second abutting surface 141*a*.

Under the foregoing structural configurations, the lower edges of the first magnetic attraction portion 331 and the second magnetic attraction portion 141 can avoid wear and tear due to excessive pushing when the keycap 150 is at the lowest position relative to the bottom plate 110 (referring to FIG. 4B).

In some embodiments, in order to let the keycap 150 move between the highest position and the lowest position relative to the bottom plate 110 more smoothly, the junction between the first abutting surface 331*a* and the third abutting surface 331*b* can be designed as a camber angle.

Figure 5B:
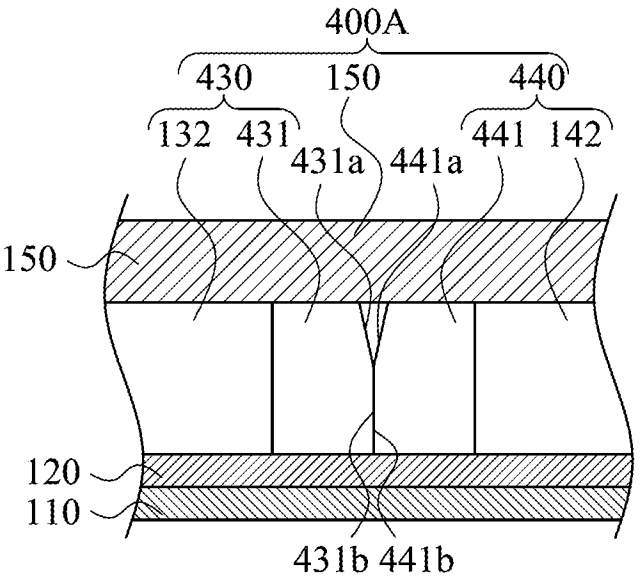
FIG. 5B is another partial cross-sectional view of the keyswitch device shown in FIG. 5A, in which the keycap is at the lowest position relative to the bottom plate.
Figure 5A:
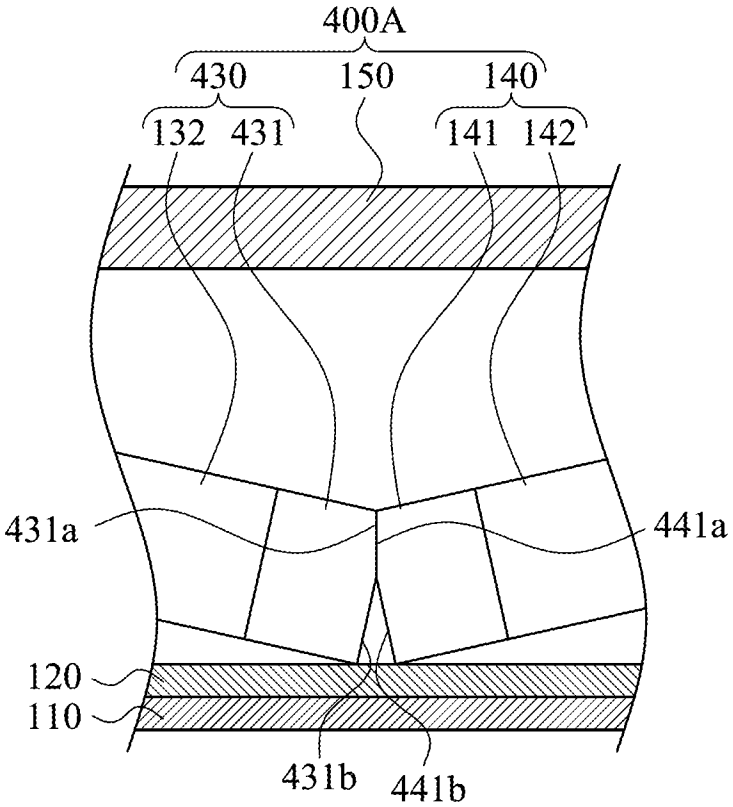
FIG. 5A is a partial cross-sectional view of a keyswitch device of the keyboard according to some embodiments of the disclosure, in which the keycap is at the highest position relative to the bottom plate.

Reference is made to FIGS. 5A and 5B. FIG. 5A is a partial cross-sectional view of a keyswitch device 400A of the keyboard 100 according to some embodiments of the disclosure, in which the keycap 150 is at the highest position relative to the bottom plate 110. FIG. 5B is another partial cross-sectional view of the keyswitch device 400A shown in FIG. 5A, in which the keycap 150 is at the lowest position relative to the bottom plate 110. Compared with the embodiment shown in FIG. 2A, the keyswitch device 400A of the present embodiment mainly modifies the first magnetic attraction portion 431 of the first supporting member 430 and the second magnetic attraction portion 441 of the second supporting member 440, and the keycap 150 included in the keyswitch device 400A can be referred to the above related descriptions and would not repeated here for simplicity. Specifically, in the present embodiment, the first magnetic attraction portion 431 further has a third abutting surface 431*b* in addition to the first abutting surface 431*a*. The third abutting surface 431*b* is connected to the first abutting surface 431*a*. The second magnetic attraction portion 441 further has a fourth abutting surface 441*b* in addition to the second abutting surface 441*a*. The fourth abutting surface 441*b* is connected to the second abutting surface 441*a*. When the keycap 150 is at the highest position relative to the bottom plate 110, the first abutting surface 431*a* abuts against the second abutting surface 441*a*, and the third abutting surface 431*b* and the fourth abutting surface 441*b* are inclined away from each other at the same time. When the keycap 150 moves to the lowest position relative to the bottom plate 110, the first abutting surface 431*a* is separated from the second abutting surface 441*a*, and the third abutting surface 431*b* abuts against the fourth abutting surface 441*b*. That is, the first magnetic attraction portion 431 and the second magnetic attraction portion 441 respectively disposed on the first supporting member 430 and the second supporting member 440 attract each other, and the first abutting surface 431*a* abuts against the second abutting surface 441*a*, so as to achieve the purpose of returning the keycap 150 to the highest position when the keycap 150 is not pressed. When the first abutting surface 431*a* abuts against the second abutting surface 441*a* (referring to FIG. 5A), the keycap 150 is at the highest position relative to the bottom plate 110. When the keycap 150 moves toward the bottom plate 110 from the highest position (referring to FIG. 5B), the first abutting surface 431*a* is separated from the second abutting surface 441*a*, and the third abutting surface 431*b* abuts against the fourth abutting surface 441*b*.

Under the foregoing structural configurations, the lower edges of the first magnetic attraction portion 431 and the second magnetic attraction portion 441 can also avoid wear and tear due to excessive pushing when the keycap 150 is at the lowest position relative to the bottom plate 110 (referring to FIG. 5B).

In some embodiments, in order to let the keycap 150 move between the highest position and the lowest position relative to the bottom plate 110 more smoothly, the junction between the first abutting surface 431*a* and the third abutting surface 431*b* can be designed as a camber angle, and/or the second abutting surface 441*a* and the fourth abutting surface 441*b* can be designed as a camber angle.

Figure 6:
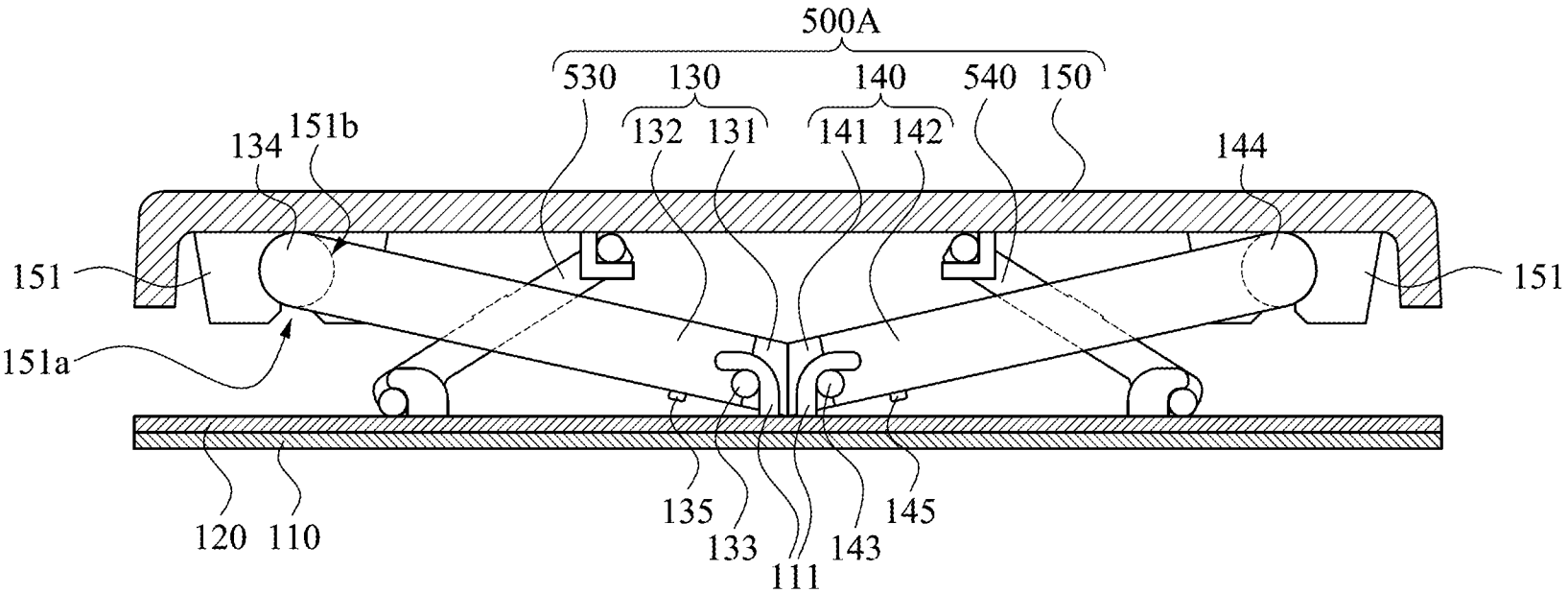
FIG. 6 is a cross-sectional view of a keyswitch device, a part of a bottom plate, and a part of a circuit board of the keyboard according to some embodiments of the disclosure, in which the keycap is at the highest position relative to the bottom plate.

Reference is made to FIG. 6. FIG. 6 is a cross-sectional view of a keyswitch device 500A, a part of a bottom plate 110, and a part of a circuit board 120 of the keyboard 100 according to some embodiments of the disclosure, in which the keycap 150 is at the highest position relative to the bottom plate 110. Compared with the embodiment shown in FIG. 2A, the keyswitch device 500A of the present embodiment also includes the first supporting member 130, the second supporting member 140, and the keycap 150, and these components can be referred to the above related descriptions and would not repeated here for simplicity. In addition, the keyswitch device 500A of the present embodiment further includes a third supporting member 530 and a fourth supporting member 540. The third supporting member 530 is connected between the bottom plate 110 and the keycap 150 and pivotally connected to an inner edge of the first opening portion 136 (referring to FIG. 1B). The fourth supporting member 540 is connected between the bottom plate 110 and the keycap 150 and pivotally connected to an inner edge of the second opening portion 146 (referring to FIG. 1B).

For example, the inner edge of the first opening portion 136 of the first supporting member 130 has a shaft hole, and the third supporting member 530 has a connecting shaft. As such, the third supporting member 530 can be rotatably connected to the first supporting member 130 by accommodating the connecting shaft in the shaft hole. When the keycap 150 is at the highest position relative to the bottom plate 110, the first supporting member 130 and the third supporting member 530 form an X shape (referring to FIG. 6). The inner edge of the second opening portion 146 of the second supporting member 140 has a shaft hole, and the fourth supporting member 540 has a connecting shaft. As such, the fourth supporting member 540 can be rotatably connected to the second supporting member 140 by accommodating the connecting shaft in the shaft hole. When the keycap 150 is at the highest position relative to the bottom plate 110, the second supporting member 140 and the fourth supporting member 540 form an X shape (referring to FIG. 6).

With the foregoing structural configurations, the keyswitch device 500A of the present embodiment can further provide more structural strength and stability by the third supporting member 530 and the fourth supporting member 540.

According to the foregoing recitations of the embodiments of the disclosure, it can be seen that in the keyboard of the present disclosure, the two supporting members guide the keycap to move toward and away from the bottom plate, and the two magnetic attraction portions that are respectively disposed on the supporting members and attract each other cause the keycap to return to its original position when the keycap is not pressed. The magnetic attraction portions can replace conventional rubber domes, so as to effectively reduce the stroke of the keycap and thus help to thin the keyboard. Furthermore, the first supporting member and the second supporting member are arranged in the horizontally symmetrical manner and each at least partially includes a metal material, so the keyboard adopting the first supporting member and the second supporting member still has enough structural strength even a conventional balance bar is not installed therein.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a bottom plate; and a plurality of keyswitch devices each comprising:

a keycap over the bottom plate;

a first supporting member connected between the bottom plate and the keycap and comprising a first magnetic attraction portion, the first magnetic attraction portion having a first abutting surface; and a second supporting member connected between the bottom plate and the keycap and comprising a second magnetic attraction portion configured to attract the first magnetic attraction portion, the second magnetic attraction portion having a second abutting surface, wherein when the first abutting surface abuts against the second abutting surface, the keycap is at a highest position relative to the bottom plate, and when the keycap moves toward the bottom plate from the highest position, the first abutting surface is at least partially separated from the second abutting surface.

2. The keyboard of claim 1, wherein each of the first supporting member and the second supporting member has a lower engaging shaft and an upper engaging shaft respectively engaged with the bottom plate and the keycap.

3. The keyboard of claim 2, wherein the first supporting member and the second supporting member are arranged in a horizontally symmetrical manner, and a distance between the lower engaging shafts is smaller than a distance between the upper engaging shafts.

4. The keyboard of claim 2, wherein the first magnetic attraction portion is proximal to the lower engaging shaft of the first supporting member, and the second magnetic attraction portion is proximal to the lower engaging shaft of the second supporting member.

5. The keyboard of claim 4, wherein an attraction interface between the first magnetic attraction portion and the second magnetic attraction portion is between the lower engaging shafts.

6. The keyboard of claim 2, wherein the keycap has an engaging structure having an engaging hole, and one of the upper engaging shafts is rotatably engaged with the engaging hole.

7. The keyboard of claim 6, wherein the upper engaging shaft that is engaged with the engaging hole is further slidably engaged with the engaging hole.

8. The keyboard of claim 6, wherein the engaging hole is in the shape of an elongated slot and extends substantially parallel to the bottom plate.

9. The keyboard of claim 2, wherein the bottom plate has a hook, and one of the lower engaging shafts is slidably engaged with the hook.

10. The keyboard of claim 2, wherein one of the first supporting member and the second supporting member further has a triggering portion, and the triggering portion faces toward the bottom plate and faces away from the keycap.

11. The keyboard of claim 10, wherein the triggering portion is proximal to one of the lower engaging shafts.

12. The keyboard of claim 1, wherein the first supporting member further comprises a main body portion, one end of the main body portion is connected to the first magnetic attraction portion, and the main body portion comprises a metal material.

13. The keyboard of claim 12, wherein the first supporting member is ring-shaped.

14. The keyboard of claim 12, wherein the main body portion and the first magnetic attraction portion are connected through a cold solder.

15. The keyboard of claim 1, wherein further comprising a circuit board disposed on the bottom plate.

16. A keyboard, comprising:

a bottom plate; and a plurality of keyswitch devices each comprising:

a keycap over the bottom plate;

a first supporting member connected between the bottom plate and the keycap and comprising a first magnetic attraction portion, the first magnetic attraction portion having a first abutting surface; and a second supporting member connected between the bottom plate and the keycap and comprising a second magnetic attraction portion configured to attract the first magnetic attraction portion, the second magnetic attraction portion having a second abutting surface, wherein when the first abutting surface abuts against the second abutting surface, the keycap is at a highest position relative to the bottom plate, and when the keycap moves toward the bottom plate from the highest position, the first abutting surface is at least partially separated from the second abutting surface, wherein the first magnetic attraction portion further has a third abutting surface connected to the first abutting surface, and when the keycap moves to a lowest position relative to the bottom plate, the third abutting surface abuts against the second abutting surface.

17. A keyboard, comprising:

a bottom plate; and a plurality of keyswitch devices each comprising:

a keycap over the bottom plate;

a first supporting member connected between the bottom plate and the keycap and comprising a first magnetic attraction portion, the first magnetic attraction portion having a first abutting surface; and a second supporting member connected between the bottom plate and the keycap and comprising a second magnetic attraction portion configured to attract the first magnetic attraction portion, the second magnetic attraction portion having a second abutting surface, wherein when the first abutting surface abuts against the second abutting surface, the keycap is at a highest position relative to the bottom plate, and when the keycap moves toward the bottom plate from the highest position, the first abutting surface is at least partially separated from the second abutting surface, wherein the first magnetic attraction portion further has a third abutting surface connected to the first abutting surface, the second magnetic attraction portion further has a fourth abutting surface connected to the second abutting surface, and when the keycap moves to a lowest position relative to the bottom plate, the third abutting surface abuts against the fourth abutting surface.

18. A keyboard, comprising:

a bottom plate; and a plurality of keyswitch devices each comprising:

a keycap over the bottom plate;

a first supporting member connected between the bottom plate and the keycap, having a first opening portion, and comprising a first magnetic attraction portion, the first magnetic attraction portion having a first abutting surface;

a second supporting member connected between the bottom plate and the keycap, having a second opening portion, and comprising a second magnetic attraction portion configured to attract the first magnetic attraction portion, the second magnetic attraction portion having a second abutting surface;

a third supporting member connected between the bottom plate and the keycap and pivotally connected to an inner edge of the first opening portion; and a fourth supporting member connected between the bottom plate and the keycap and pivotally connected to an inner edge of the second opening portion, wherein when the first abutting surface abuts against the second abutting surface, the keycap is at a highest position relative to the bottom plate, and when the keycap moves toward the bottom plate from the highest position, the first abutting surface is at least partially separated from the second abutting surface.

* * * * *